United States Patent [19]

Anstötz et al.

[11] Patent Number: 4,902,384

[45] Date of Patent: Feb. 20, 1990

[54] WET PRESS WITH VIBRATION CONTROL

[75] Inventors: Helmut Anstötz, Tönisvorst; Bernhard Brendel, Grefrath 2-Mülhausen; Günter Schrörs, Tönisvorst, all of Fed. Rep. of Germany

[73] Assignee: Eduard Küsters Maschinenfabrik GmbH & Co KG, Krefeld, Fed. Rep. of Germany

[21] Appl. No.: 202,094

[22] Filed: Jun. 3, 1988

[30] Foreign Application Priority Data

Jun. 13, 1987 [DE] Fed. Rep. of Germany ..... 3719828

[51] Int. Cl.[4] ..... D21F 3/02; D21F 1/24

[52] U.S. Cl. ..... 162/252; 162/262; 162/274; 162/358; 100/118; 100/153

[58] Field of Search ..... 162/256, 257, 262, 263, 162/273, 274, 305, 358, 360.1, 252; 100/118, 153

[56] References Cited

U.S. PATENT DOCUMENTS

| | | | |
|---|---|---|---|
| 2,484,473 | 10/1949 | Staege | 162/257 |
| 3,517,819 | 6/1970 | Helland | 210/400 |
| 4,077,834 | 3/1978 | Stark | 162/273 |
| 4,140,574 | 2/1979 | Justus | 162/273 |

FOREIGN PATENT DOCUMENTS

| | | |
|---|---|---|
| 1182318 | 2/1985 | Canada . |
| 1169275 | 4/1964 | Fed. Rep. of Germany . |
| 1760199 | 4/1973 | Fed. Rep. of Germany . |

OTHER PUBLICATIONS

Stark, Th., "Elektronischer Regler zur gleichzeitigen Regelung von Lauf and Spannung bei Filzen und Sieben, mit nur einer walze", Wochenblatt f. Papierfabrikation, Jul. 1976, pp. 235–242.

*Primary Examiner*—Richard V. Fisher
*Assistant Examiner*—Christopher Upton
*Attorney, Agent, or Firm*—Kenyon & Kenyon

[57] ABSTRACT

A wet press of a paper-making machine includes a pair of rolls defining a roll gap through which the paper to be treated and belt-shaped felt are simultaneously conducted. The felt is guided in a closed loop path by additional rolls which include a tightening roll. The tightening roll can be tilted to reduce roll vibrations by tightening the felt to set vibratory marks formed in the felt at an angle relative to the transverse width of the felt and the roll gap. A controllable positioning device is provided which includes a motor operated by a controller during predetermined time intervals or as a function of actual vibrations sensed at the pair of rolls forming the roll gap to automatically vary the tilt angle.

9 Claims, 1 Drawing Sheet

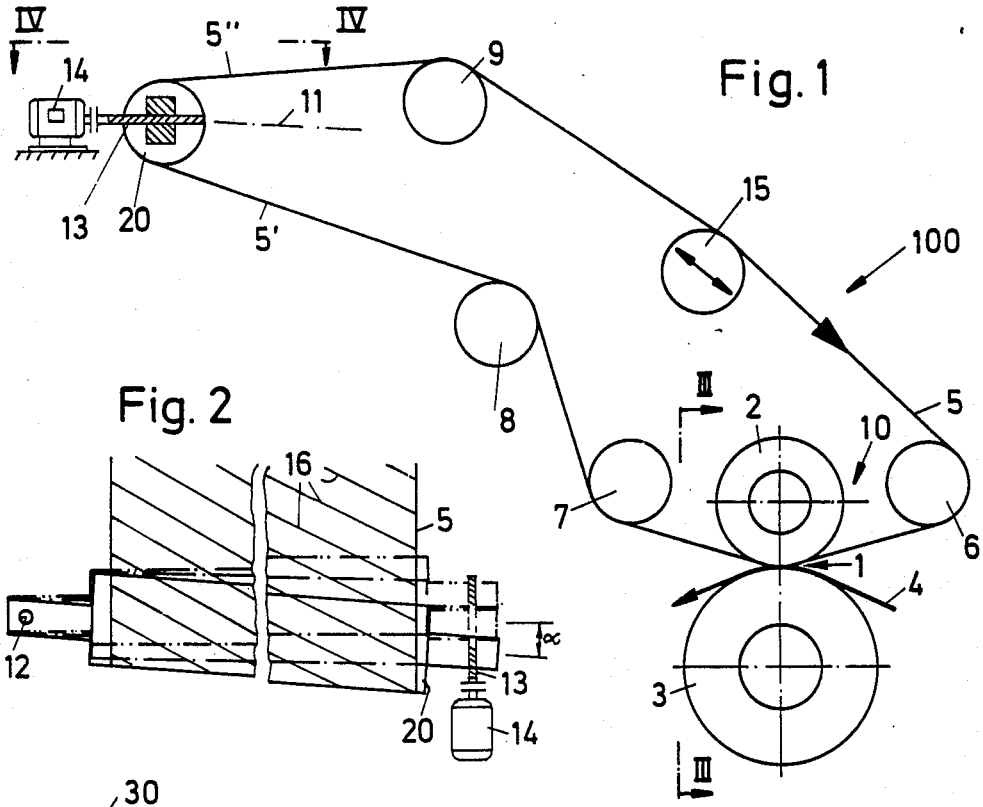
Fig. 1
Fig. 2
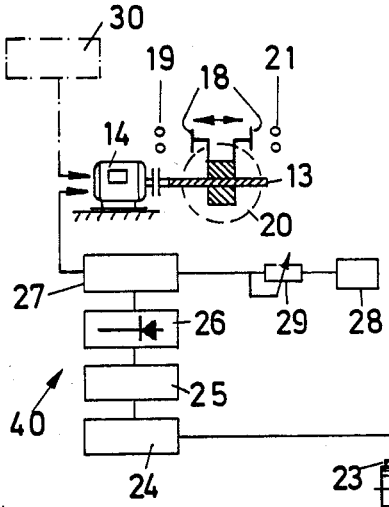
Fig. 3
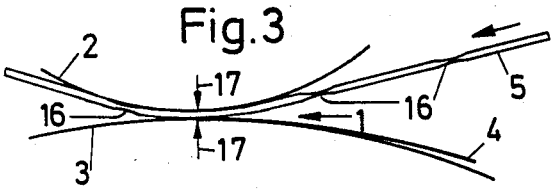
Fig. 4
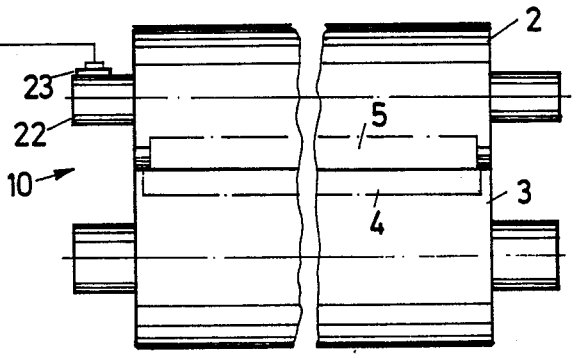

WET PRESS WITH VIBRATION CONTROL

BACKGROUND OF THE INVENTION

The invention relates generally to a wet press of a paper making machine and more particularly to a wet press having a tiltable felt-tightening roll.

Wet presses of paper-making machines having the following elements for treating paper webs are known: a pair of first rolls defining a roll or press gap through which the paper web is conducted, second rolls defining a closed loop path which includes the roll gap, a belt-shaped felt guided by and revolving around said second rolls in the closed loop path with the web and felt being simultaneously conducted through the roll gap, the second rolls including a tightening roll pivotally supported at one end with the felt being looped around the tightening roll with a section of the felt running toward the tightening roll and a section of the felt running away from the tightening roll and a manually operable means for tilting the tightening roll by a given tilt angle which lies in a plane located in the space between the felt sections and which passes through the longitudinal axis of the tightening roll.

In such wet presses, as the felt and paper web to be drained are simultaneously conducted through the roll gap, water is pressed out of the paper web and is transferred onto the felt web. The absorbed water is removed from the felt at another point along its closed loop path by, for instance, a suction roll.

The pair of rolls forming the roll gap, along with their guides which engage roll journals and the elastically resilient felt, form a vibrating system with a large number of resonance vibrations that can be excited during operation of the wet press. Vibrations in the range of about 20 to 150 Hz typically occur and manifest themselves as a loud humming sound.

Such phenomena becomes particularly pronounced if at least one of the rolls of the pair is a flexure-controlled roll, i.e., a hydraulically supported rotatable hollow roll having a stationary crosspiece extending through the hollow roll and forming a small clearance space therewith which contains the supporting liquid. The vibration problem is exacerbated with flexure-controlled rolls because such rolls comprise several parts which add to the number of vibratory degrees of freedom.

The vibrations and noise produced are not only a nuisance, but also have a negative effect on the operation of the wet press. This problem applies particularly to so-called "beaten path vibrations" which either occur in the plane connecting the axes of the rolls forming the roll gap or have a component in this plane. When the rolls vibrate toward each other in this plane, the portion of felt located in the roll gap at the instant the vibration occurs is greatly compressed and forms a mark in the felt. During the remaining times when the rolls vibrate away from each other little or no compression results. Under certain geometric conditions, after some period of operation the marks develop in the felt in a line pattern which extends transverse to the direction of felt motion and becomes permanently impressed on the felt. These marks can excite resonate frequencies of the wet press thereby causing amplification of the vibrations.

The felt compression along the lines also hampers the absorption characteristics of the felt. The felt has a reduced service life when vibrations occur because its drainage action is reduced due to the line pattern which results in linear hardened zones. Therefore, the felt must be replaced sooner than if it was uniformly stressed under diminished vibratory conditions. The generation of the vibratory marks in the transverse line pattern greatly reduces the service life of the felt which would be otherwise possible. Furthermore, these irregularities in the absorption capability of the felt adversely affect the treated paper web as uneven draining of the paper web results therefrom. Additionally, the transverse line pattern remains Visible after the paper is completely dry. Hence, these vibrations lead to diminished paper quality.

The foregoing problems indicate that there is great interest in preventing the occurrence of the self-amplifying vibrations in a wet press generated by the transverse line pattern in the felt. In known wet presses of the prior art means are provided to attenuate the excitation of vibrations by transverse marks in the felt web. Typically this is accomplished by tightening the felt by means of a pivotally supported tightening roll. Tilting of the tightening roll tightens the felt into a generally parallelogram-like shape which prevents the vibratory marks from forming in a transverse direction, i.e., perpendicular to the running direction of the felt. The marks are now formed at a certain angle and the entire length of a mark does not reach the roll gap simultaneously. This largely cancels the excitation effect of the marks arriving at the roll gap.

If the tightening roll is tilted and the felt is not lengthened on its other side, destruction of the felt and in particular, lateral run-off of the felt would occur due to the shear stress induced. Therefore, the effects of the displacement or tilting of the tightening roll at one edge must be compensated by corresponding displacement at the other edge or by other similar measures.

In the known wet presses discussed above, the tightening roll is tilted manually by a spindle. The machine operator recognizes, from experience, by the noise generated by the wet press when tilting intervention is necessary. He then operates the spindle to tilt the tightening roll by a certain amount until the noise is reduced. After several hours or days, the felt has run-in in its new tightened position and new marks begin to form which excite the corresponding resonance vibrations of the roll arrangement and lead to amplified vibrations At such time, more intervention is required.

One of the problems With the prior art arrangement is that continuous monitoring and correspondingly great experience of the machine operator are required in order to maintain efficient, orderly and vibration-free operation of the wet press. The present invention solves this problem by providing for operation of the vibration suppression means in the known wet press independent of the continuous attention and intervention of the machine operator.

SUMMARY OF THE INVENTION

This is accomplished by provision of a controllable positioning device which is operable to tilt the tightening roll and means for automatically varying the tilt angle operably coupled to the controllable positioning device. In this manner, vibration suppression is obtained by operation of the controllable positioning device, which may comprise an electric motor, by the means for automatically varying the tilt angle to change the tilt angle in accordance with suitable criteria. The automatic tilt angle varying means may comprise a controller which operates the motor at predetermined time intervals independent of the actual vibratory condition prevailing in the press at a given instant. This prevents development of distinct vibratory marks in the felt. The tilt angle may be increased in equal steps in one direction up to a limit angle and then in an opposite direction in the same or similar steps up to an opposite limit angle via a contact arrangement forming part of the controller.

According to another embodiment the automatic tilt angle varying means comprises a controller which operates in dependence on the actual vibratory condition sensed at the pair of rolls. If .he sensed vibratory condition does not increase over a predetermined reference value the controller does not operate the motor to change the tilt angle of the tightening roll. A vibration sensor is provided for at least one of the pair of rolls and may comprise an acceleration sensor. In the case of hydraulically supported hollow rolls of the type previously mentioned, the acceleration sensor may be advantageously mounted at one or more of the ends of the crosspiece protruding from the hollow roll. Mounting the sensor at this position is advantageous because the accelerations occurring at the ends of such a roll are at a maximum value and therefore, measurement at the ends is more accurate than at other points along the roll. The controller of this embodiment may include means for calculating a mean value of the acceleration over a longer time interval than that calculated by the sensor.

BRIEF DESCRIPTION OF THE DRAWINGS

FIG. 1 is a side view of a wet press of a papermaking machine constructed according to the principles of invention.

FIG. 2 is a partial top view of the press taken along section IV—IV in FIG. 1.

FIG. 3 is an enlarged partial view of the roll or press gap.

FIG. 4 is a schematic view shown partially in cross section, of the controller for the controllable positioning device taken along section III—III in FIG. 1.

DETAILED DESCRIPTION

The wet press, generally designated in FIG. 1 as 100, comprises a pair of rolls 10 forming a roll or press gap 1 between upper roll 2 and the lower roll 3. One or more of the rolls 2, 3 are flexure-controlled, i.e. comprise a stationary crosspiece extending through a hollow rotatable roll to form a clearance space therewith. The clearance space is supplied with a liquid for hydraulically supporting the hollow roll. The protruding ends of the crosspiece are supported in a paper-making machine frame by swinging levers or other guiding devices which are not shown in FIG. 1.

Both the paper web 4 to be drained and the belt-shaped felt 5, which is at least as wide as the paper web 4, are simultaneously conducted through the gap 1. The felt 5 runs in the manner shown in FIG. 1 in a closed loop path generally defined by guiding and deflection rolls 6, 7, 8 and 9. Rolls 6 and 7 are arranged at about the same elevation relative to the upper roll 2 such that the felt 5 is looped around the upper roll 2 at an angle of about 140° .

The guiding and deflection rolls 8, 9 are arranged vertically above the pair of rolls 10. The felt 5 is guided by rolls 8 and 9 over a tightening roll 20 which is arranged such that the section 5' of the felt 5 approaching the tightening roll 20 and the section 5'' leaving the tightening roll 20 form an angle of about 25° with each other. The tightening roll 20 can be tilted in a plane 11 located within the acute angle formed by sections 5', 5'' of the felt 5 and passing through the axis of the tightening roll 20. As can be seen from FIG. 2 the tightening roll 20 is pivotally supported at one end on a pivot 12 while the other end of the tightening roll can be displaced in plane 11 by a spindle 13 in the manner shown in FIG. 2. A controllable positioning device, such as electric motor 14, drives the spindle 13. The motor is automatically operated by a controller 30 or 40 which automatically varies the angle by which roll 20 is tilted.

The normal position of the tightening roll 20 is indicated in FIG. 2 by dashed-dotted lines. In this position, the longitudinal axis of the tightening roll 20 is perpendicular to the longitudinal direction of the felt 5. A tightened position is shown in FIG. 2 by solid lines. In this position the right end of the tightening roll 20 is displaced downwardly by the angle $\alpha$ . To ensure that felt 5 remains in the center of the tightening roll 20 and does not laterally run off the roll 20 despite movement to a tightened position, a control roll 15 is provided at another point along the felt 5. Control roll 15 counteracts the tendency of felt 5 to run-off resulting from the tilting of the tightening roll 20.

The tightening roll 20 can also be displaced upwardly as shown in FIG. 2 by the dashed-double-dot lines. A displacement of the tightening roll 20 into the position shown in FIG. 2 by solid lines deforms the felt 5 into a generally parallelogram-like shape as shown in FIG. 2. Marks 16, which previously extended exactly transversely to the felt and gap 1 when roll 20 occupied its dashed-dotted line position, are now formed at an angle relative to the gap in the manner shown. Use of a tightening roll 20 of about 6 m long and a felt 5 of corresponding width, while displacing the right end of the tightening roll at the spindle 13 by about 100 mm upwardly or downwardly, produces about a 50 cm displacement of the marks 16 relative to the edge of the felt. Thus, rather considerable angular positions of the marks 16 can be achieved by relatively slight displacements of the right end of the tightening roll 20.

In FIG. 3, the conditions existing at the roll gap 1 are shoWn in a greatly enlarged manner. At the instant illustrated in FIG. 3, if a vibration is excited in rolls 2, 3, leading to relative motion of the rolls 2, 3 to decrease the roll gap (as shown by the direction of the arrows 17) a compression point in the felt 5 results. As the vibration continues, the next instant is followed by less compressed regions as the rolls 2, 3 move away from each other in a direction opposite to arrows 17. Thus, the compression points produces marks 16 in the felt at given spacings which can be calculated from the frequency of the vibration excited. The marks 16 extend transversely to the longitudinal running direction of the felt 5 and are conducted into the roll gap again in the manner shown in FIG. 3 (after the felt has made one complete revolution) in a rhythm or frequency which corresponds exactly to the resonance vibration of the rolls 2, 3 in the direction of the arrows 17. In this manner, after the marks 16 have been formed, the resonance vibrations of the rolls 2, 3 are additionally excited at exactly the right frequency and are thus amplified. However, this occurs only if the entire length of the marks 16 is conducted into the roll 1 at the same instant, i.e, the marks extend exactly transverse to felt 5 and parallel to gap 1 as the marks pass through the gap 1.

If the entire length of the marks 16 does not run into the roll 1 simultaneously, the excitation effect of the marks 16 practically no longer exists. The angular position of the marks 16 shown in FIG. 2 is generated to avoid this excitation effect.

After the tightening roll 20 has been tilted into one of the positions indicated in FIG. 2 to generate an angular position of the marks 16, new marks which extend exactly transverse to the felt 5 are formed after the passage of time by a new excitation of the resonance vibrations of the rolls 2, 3 in the direction of the arrows 17. These vibrations are quickly amplified by the newly formed transversely extending marks. Therefore, after some time, the felt 5 must again be set at an angle to eliminate the newly formed transversely extending line pattern.

In the wet press 100 of the invention, repeated changes in the tilt angle setting takes place automatically due to a controller 30 or 40. Two alternative controller embodiments for accomplishing automatic angle variation are shown in FIG. 4. In the embodiment indicated by dash-dotted lines, the control device 30 comprises a simple timing switch which, following a given timing program, for instance, switches on the motor 14 at uniform time intervals for a short time period. This causes displacement of spindle 13 and corresponding tilting of the tightening roll 20 by a certain angular amount. Operatively associated with roll 20 and forming part of the controller is a contact 18 which is operably connected to the roll 20 and moves simultaneously therewith. The tilting occurs in the same direction until contact 18 is moved into abutment with one of the spaced stationary contacts 19 and 20. In these positions a limiting angle of tilting has been reached and the closing of the contacts completes a circuit operable upon the next actuation of the motor to reverse the direction of rotation of the motor 14 until movable contact 18 abuts against the other of the contacts 19 and 21 and the cycle is repeated. Thus any tilting of roll 20 that occurs after the contacts 18, and 19 or 21 first abut, occurs in the opposite direction. In this manner, the pivoting end of the tightening roll 20 swings back and forth between the fixed contacts 19, 21 and the relative tightness of the felt 5 and the angular position of the respectively formed marks 16, changes again and again over time.

In the embodiment shown as controller 40 (solid lines in FIG. 4) a fixed timing program is not provided, but rather the actuation of the motor 14 depends upon the actual vibrations present at the rolls 2, 3 at a given point in time. In this embodiment, controller 40 comprises an acceleration sensor 23 attached to the protruding end 22 of the crosspiece of the upper roll 2. The signal of sensor 23 is amplified in a measuring amplifier 24, sent to a bandpass filter 25 and then a rectifier 26. A rectified signal from rectifier 26 is fed to a memory-programmable control device 27 which also receives, from a d-c voltage source 28, a d-c voltage signal which can be set via a potentiometer 29. The d-c voltage signal represents a given reference value which corresponds to a preset vibration intensity limit. If the signal of the acceleration sensor 23 exceeds this reference value memory-programmable control device 27 switches on the motor 14 for a given period of time to produce a tilting displacement of the tightening roll 20 by a given angular step. As with use of controller 30, the motor 14 in this embodiment also runs at constant speed when it is switched "on" and the angular limit positions are determined by abutment of the movable contact 18 with one of the fixed contacts 19, 21 which causes reversal of the tilting direction.

In practice, the value measured by the acceleration sensor 23 is determined as the mean value of the acceleration over a given short period of time, for instance one second. The memory-programmable control device 27 extrapolates this mean value at certain longer time intervals, for instance 10 minutes. Only if, upon such extrapolation the mean value is above the reference value does the controller 40 intervene to operate motor 14 to cause a displacement of the tightening roll 20.

What is claimed is:

1. A wet press of a paper-making machine for treating a paper web comprising:

(a) a pair of first rolls defining a roll gap through which the paper web is conducted;

(b) second rolls defining a closed loop path which includes said roll gap;

(c) a belt-shaped felt guided by and revolving around said second rolls in the closed loop path, with the paper web and said felt being simultaneously conducted through the roll gap;

(d) said second rolls including a tightening roll pivotally supported at one end, said felt being looped around said tightening roll with a section of the felt running toward the tightening roll and a section of the felt running away from the tightening roll;

(e) a controllable positioning device connected to the other end of the tightening roll, said controllable positioning device being operable to tilt the tightening roll about said one end by a given tilt angle which lies in a plane located in the space between said felt sections and which passes through the longitudinal axis of the tightening roll; and (f) means for automatically varying the tilt angle including a controller operably coupled to said controllable positioning device, said controller operating said controllable positioning device at predetermined time intervals.

2. A wet press according to claim 1 wherein said controllable positioning device comprises a motor.

3. A wet press according to claim 1 wherein said controller further comprises a movable contact operably connected to said tightening roll, a pair of spaced stationary contacts cooperating with said movable contact to define angular limits for said tilt angle whereby the tilt angle is varied in equal angular steps in a first direction until one of said angular limits is reached and the next angular change of the tilt angle occurs in a second direction opposite to said first direction.

4. A wet press of a paper-making machine for treating a paper web comprising:

(a) a pair of first rolls defining a roll gap through which the paper web is conducted;

(b) second rolls defining a closed loop path which includes said roll gap;

(c) a belt-shaped felt guided by and revolving around said second rolls in the closed loop path, with the paper web and said felt being simultaneously conducted through the roll gap;

(d) said second rolls including a tightening roll pivotally supported at one end, said felt being looped around said tightening roll with a section of the felt running toward the tightening roll and a section of the felt running away from the tightening roll;

(e) a controllable positioning device connected to the other end of the tightening roll, said controllable positioning device being operable to tilt the tightening roll about said one end by a given tilt angle which lies in a plane located in the space between said felt sections and which passes through the longitudinal axis of the tightening roll; and (f) means for automatically varying the tilt angle including a controller operably coupled to said controllable positioning device and a vibration sensor operably connected to at least one of said first rolls, said vibration sensor generating a signal indicative of the actual vibration of said at least one first roll, said controller operating said controllable positioning device as a function of the signal of the vibration sensor.

5. A wet press according to claim 4 wherein said vibration sensor comprises an acceleration sensor.

6. A wet press according to claim 5, wherein said controller includes means for calculating a mean value of the acceleration of said at least one first roll, said controller further including means for comparing the mean value of the acceleration to a reference value indicative of a vibration intensity limit, said controller providing a signal to operate said controllable positioning device as a function of the difference between said mean value and said reference value.

7. A wet press according to claim 5 wherein said at least one first roll comprises a hydraulically supported hollow roll including a stationary crosspiece extending through the hollow roll, said crosspiece having ends protruding from the roll with said sensor being mounted on one of said ends.

8. A wet press according to claim 7 wherein said controller includes means for calculating a mean value of the acceleration of said at least one first roll, said controller further including means for comparing the mean value of the acceleration to a reference value indicative of a vibration intensity limit, said controller providing a signal to operate said controllable positioning device as a function of the difference between said mean value and said reference value.

9. A wet press according to claim 4 wherein said controllable positioning device comprises a motor.

* * * * *